US005632607A

United States Patent [19]

Popescu et al.

[11] Patent Number: 5,632,607

[45] Date of Patent: May 27, 1997

[54] PISTON AND VALVE ARRANGEMENT FOR A WOBBLE PLATE TYPE PUMP

[75] Inventors: Niculae G. Popescu, Glendora; Christopher J. Taylor-McCune, Mission Viejo; Michael A. George, Riverside, all of Calif.

[73] Assignee: Shurflo Pump Manufacturing Co., Santa Ana, Calif.

[21] Appl. No.: 551,567

[22] Filed: Nov. 1, 1995

[51] Int. Cl.[6] ..... F04B 53/10; F04B 53/14

[52] U.S. Cl. ..... 417/415; 417/269; 417/560; 417/566; 137/512.4; 92/71; 92/248

[58] Field of Search ..... 417/269, 271, 417/307, 413.1, 419, 560, 566, 415; 137/512.4; 92/71, 248

[56] References Cited

U.S. PATENT DOCUMENTS

| | | | |
|---|---|---|---|
| 3,314,600 | 4/1967 | Hadley . | |
| 3,496,872 | 2/1970 | Riester et al. . | |
| 3,572,375 | 3/1971 | Rosenberg . | |
| 4,153,391 | 5/1979 | Hartley . | |
| 4,242,061 | 12/1980 | Hartley . | |
| 4,305,702 | 12/1981 | Hartley . | |
| 4,396,357 | 8/1983 | Hartley . | |
| 4,486,151 | 12/1984 | Korhonen-Wesala . | |
| 4,507,058 | 3/1985 | Shoenmeyr | 417/271 |
| 4,610,605 | 9/1986 | Hartley | 417/269 |
| 4,743,169 | 5/1988 | Funakawa et al. . | |
| 4,776,776 | 10/1988 | Jones . | |
| 5,129,794 | 7/1992 | Beatty . | |
| 5,203,803 | 4/1993 | Shoenmeyr . | |
| 5,301,663 | 4/1994 | Small, Jr. . | |
| 5,344,292 | 9/1994 | Rabenau et al. . | |

FOREIGN PATENT DOCUMENTS

| | | |
|---|---|---|
| 404255593 | 9/1992 | Japan . |

*Primary Examiner*—Timothy Thorpe
*Assistant Examiner*—Roland G. McAndrews, Jr.
*Attorney, Agent, or Firm*—Frank J. Uxa

[57] ABSTRACT

A pump comprising a housing including first and second housing sections and a gasket between the first and second housing sections. The housing has a first pumping chamber, an inlet, an inlet passage in the housing leading from the inlet to the pumping chamber, an outlet and an outlet passage in the housing leading from the pumping chamber to the outlet. A pumping member is movable in the pumping chamber to pump fluid through the pump. Inlet and outlet check valves are provided in the inlet and outlet passages, respectively with each of the check valves including a movable valve element. The outlet check valve includes an outlet valve seat and a movable outlet valve element secured to the gasket at at least two spaced apart regions.

19 Claims, 5 Drawing Sheets

SW
21
23
25
27
155
142
154
152
147
150
89
6
7
8
86
85
37
84
75
31
78
77
81
80
82
87
79
83
69
55
67
65
63
17
57
59
49
51
53

PISTON AND VALVE ARRANGEMENT FOR A WOBBLE PLATE TYPE PUMP

BACKGROUND OF THE INVENTION

This invention relates to a pump and more particularly to a positive displacement piston pump useful for pumping various liquids, such as water.

Pumps have been known for many years and the pump field is highly developed. One kind of pump which has been found very useful in pumping various liquids, such as water, is a diaphragm pump driven by a wobble plate. Pumps of this general nature are shown by way of example in Hartley U.S. Pat. Nos. 4,153,391 and 4,610,605.

Although diaphragm pumps of this type have been found very useful, there is an ongoing need to increase overall performance and pump life, simplify construction and assembly, and reduce costs and the number of parts. It is also desirable to provide enhanced check/anti-siphon valve assemblies. All of this must be accomplished while maintaining high pumping efficiency.

SUMMARY OF THE INVENTION

This invention achieves these goals. Specifically, the present invention provides for reduced stress on the piston or pistons (pumping members) of the pump so that the drive action is more effectively transmitted to the piston or pistons. Also, these pistons are preferably separate from and independent of each other so that more freedom of movement is provided. Less energy is lost, that is reduced performance drop is sustained over the life of the pump, and longer piston and pump lives are realized. The present pistons are preferably configured so that effective fluid tight seals are provided without the need for a separate diaphragm between the pumping chambers and pump housing. In addition, pumps having new valve configurations are provided and are particularly effective check and/or anti-siphon valves while being relatively easy and cost effective to produce and use.

One feature of the present invention is to use a gasket to which is secured, preferably integrally formed, a movable outlet valve element having a unique configuration. The use of such a gasket to carry or include this outlet valve element allows the valve element to be easily, and preferably controllably, preloaded, for example to bias the valve element in the closed position. The gasket preferably also includes a movable inlet valve element and may form a seal between housing sections of the pump.

Another feature of the invention is to use pistons and wobble plates which as configured, preferably matingly configured, so that the wobble plate provides support for the piston, for example, support around the entire circumference of the piston, throughout the entire movement cycle, that is back and forth between the inlet stroke and discharge stroke, of the piston. This feature reduces stress on the piston which leads to reduced performance drop (because of material creep between the piston and the wobble plate) and longer piston/pump life.

An additional feature of the invention is to use separate and independent pistons, which are preferably structured to prevent fluid leaking from the pumping chamber. This is in contrast to the use of integrally formed diaphragms which link or tie together the movement of the pistons. It has been found that using separate and independent pistons allows each piston more freedom of movement so that more efficient work is performed. In addition, effective leak prevention is preferably obtained without the need for such diaphragms. Also, the present individual pistons have a longer useful life than the above-noted diaphragms.

In a particularly useful configuration, the present pistons are adapted to be snap fitted to the wobble plate. This provides for ease of pump assembly and can increase the support given to the piston by the wobble plate.

It is sometimes necessary or desirable for a pump to have a bypass passage in the housing leading from a location in the outlet passage downstream of the outlet check valve to a location in the inlet passage upstream of the inlet check valve. A bypass valve opens in response to fluid under pressure from the outlet passage exceeding some magnitude to allow flow through the bypass passage back toward the inlet.

Another feature of this invention is that the bypass valve may include a region of the gasket and a biasing member for biasing such region of the gasket against a bypass valve seat to close the bypass passage. This region of the gasket is responsive to the fluid under pressure from the outlet passage exceeding some magnitude for moving off the bypass valve seat to open the bypass. The gasket also serves to keep the biasing member in a part of the housing which is not subjected to the fluid being pumped.

The present invention is directed to each individual feature described herein. In addition, any combination of two or more of such features, provided that such features are not mutually inconsistent, is included within the scope of the present invention.

A pump constructed in accordance with this invention may comprise a housing including first and second housing sections, a gasket between the first and second housing sections, which may form a seal between the first and second housing sections, and at least one fastener for holding the housing sections together. The housing has at least a first pumping chamber, an inlet, an inlet passage in the housing leading from the inlet to the pumping chamber, an outlet and an outlet passage in the housing leading from the pumping chamber to the outlet. A first pumping member is movable in the first pumping chamber on an intake stroke wherein a fluid from the inlet passage is drawn into the pumping chamber and a discharge stroke wherein fluid in the pumping chamber is discharged into the outlet passage. A drive is provided for moving the pumping member on the intake and discharge strokes. An inlet check valve and an outlet check valve are provided in the inlet passage and the outlet passage, respectively, with each of the check valves including a movable valve element and a valve seat. The movable outlet valve element is secured to the gasket at a plurality, that is at least two, spaced apart regions, preferably at two substantially opposing regions.

With the movable outlet valve element secured to the gasket at a plurality of spaced apart regions, the gasket or the valve element can be very effectively preloaded and/or biased so that the outlet check valve is biased toward the closed position. The gasket preferably includes flexible material and the movable outlet valve element is integrally joined to the flexible material at a plurality of spaced apart regions of this flexible material. The flexibility of the material, preferably the elasticity of the material, provides for the movement of the outlet check valve element between open and closed positions.

In a particularly useful embodiment the movable outlet valve element is placed under tension to preload or bias the outlet check valve toward the closed position. The elasticity of the material of the gasket in combination with a raised valve seat are used to form a pre-loaded or biased valve, giving an easy to assemble valve with reduced parts. In addition, this valve can be used not only as a check valve but also as an anti-siphon valve, which prevents flow at low or very low pressures in the direction of flow. The amount of preloading or biasing can be set and controlled based on the height of the seat and the material of the gasket. Thus, very effective performance effective and cost effective valve structures are obtained.

The gasket performs any one or more of the following functions: provides one or more of the valve elements of the inlet and outlet check valves, and/or forms a seal between housing sections and/or forms a portion of a bypass valve.

Preferably the gasket includes a hinge of flexible material joined to the inlet valve element whereby the valve element can be pivoted between open and closed positions. Viewed from a different perspective, the gasket includes a section of flexible material and the inlet valve element is integrally joined to such section about a hinge. Although the gasket can be formed from multiple components, preferably it is integrally molded as a unitary, one piece element.

Another pump constructed in accordance with this invention may comprise a housing, a wobble plate in the housing which wobble plate defines a chamber and a wobble mechanism mounted in the housing for imparting wobbling motion to the wobble plate. The chamber defined by the wobble plate has a longitudinal axis and is at least partially defined by an interior surface angled relative to the longitudinal axis and extending over at least a major portion, that is more than about 50%, of the length of the chamber. The housing has at least a first pumping chamber, an inlet, an inlet passage in the housing leading from the inlet to the pumping chamber, an outlet and an outlet passage in the housing leading from the pumping chamber to the outlet. A pumping member is provided and is partially located in the chamber defined by the wobble plate. This pumping member is removably secured to the wobble plate and is driven by the wobble plate. The pumping member is movable in the pumping chamber on an intake stroke whereby a fluid from the intake passage is drawn into the pumping chamber and a discharge stroke whereby fluid in the pumping chamber is discharged into the outlet passage. The pumping member includes a correspondingly angled surface in contact with or in close proximity to the interior angled surface of the wobble plate.

Having the angled interior surface of the wobble plate and the correspondingly angled surface of the pumping member in contact with or in close proximity to each other provides substantial support for the piston as it moves back and forth between the inlet stroke and the discharge stroke, particularly as it moves through the discharge stroke. This angled surface feature effectively accounts for the wobble motion of the wobble plate so that reduced material creep, over the life of the pump, is obtained. This reduced material creep results in more effective transmission of the wobble motion to the pumping member and reduces the stress and wear on the piston so that longer piston, and ultimately pump, life is obtained.

In one particularly useful embodiment, the interior angled surface of the wobble plate has a truncated conical configuration. This angled surface preferably extends around the entire circumference of the chamber defined by the wobble plate.

The chamber defined by the wobble plate preferably has opposing first and second open ends and the pumping member extends outwardly from both the opposing first and second open ends. In a very useful embodiment, the pumping member includes an element located outwardly from the opposing open end of the wobble plate away from the pumping chamber. This element has a larger cross-sectional area than the opening of the opposing open end of the wobble plate away from the pumping chamber. This feature effectively holds the pumping member in the chamber defined by the wobble plate and, ultimately, firmly secures the pumping member to the wobble plate, both on the intake stroke and the discharge stroke. The pumping member is preferably made of a elastomeric polymer material, such as the material sold under the trade name Santoprene, which allows the pumping member to be "snap" fitted to the wobble plate. In particular, the element of the pumping member (having the relatively large cross-sectional area) can be forced through the opposing open end of the wobble plate away from the pumping chamber to secure the pumping member to the wobble plate. This is an important feature of the invention in that the assembly discussed above is easily produced, and is effective to achieve the goals of the present invention.

In a very useful construction, the housing includes a first pumping chamber, a second pumping chamber, an inlet, an inlet passage in the housing leading from the inlet to the pumping chambers, an outlet and an outlet passage in the housing leading from the pumping chambers to the outlet. First and second pumping members which are separate and independent of each other are provided. These pumping members are removably secured to the wobble plate and are partially located within the open ended chambers defined by the wobble plate and extend outwardly from both of the opposing ends of the chambers of the wobble plate.

Using separate and independent pumping members provides substantial advantages, for example, as discussed above with regard to prior art diaphragms.

The invention, together with additional features and advantages thereof, may best be understood by reference to the following description taken in connection with the accompanying illustrative drawings.

DESCRIPTION OF THE PREFERRED EMBODIMENT

Figure 1:
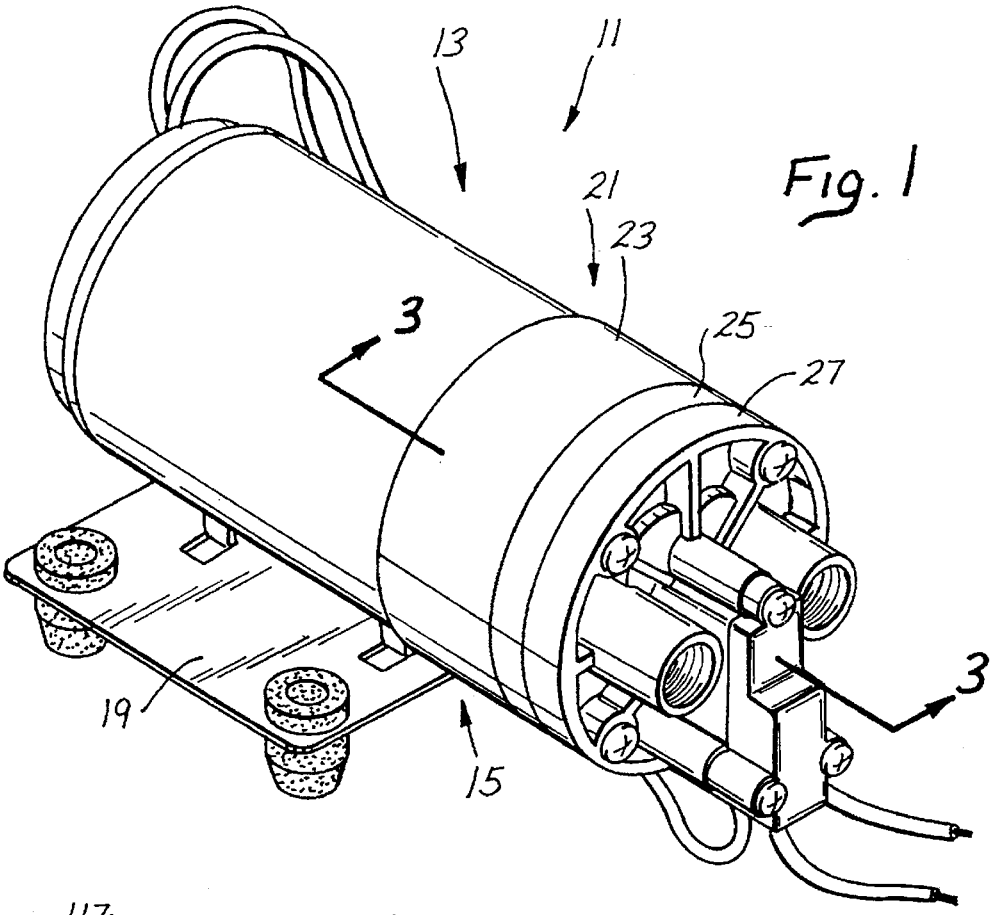
FIG. 1 is a front side view, in perspective of one preferred form of a pump constructed in accordance with the teachings of this invention.

FIG. 1 shows a pump assembly 11 which generally comprises a motor 13 and a pump 15. The motor 13 may be a conventional 110 volt AC motor having a rotatable output shaft 17 (FIG. 2) and a base plate 19.

Figure 2:
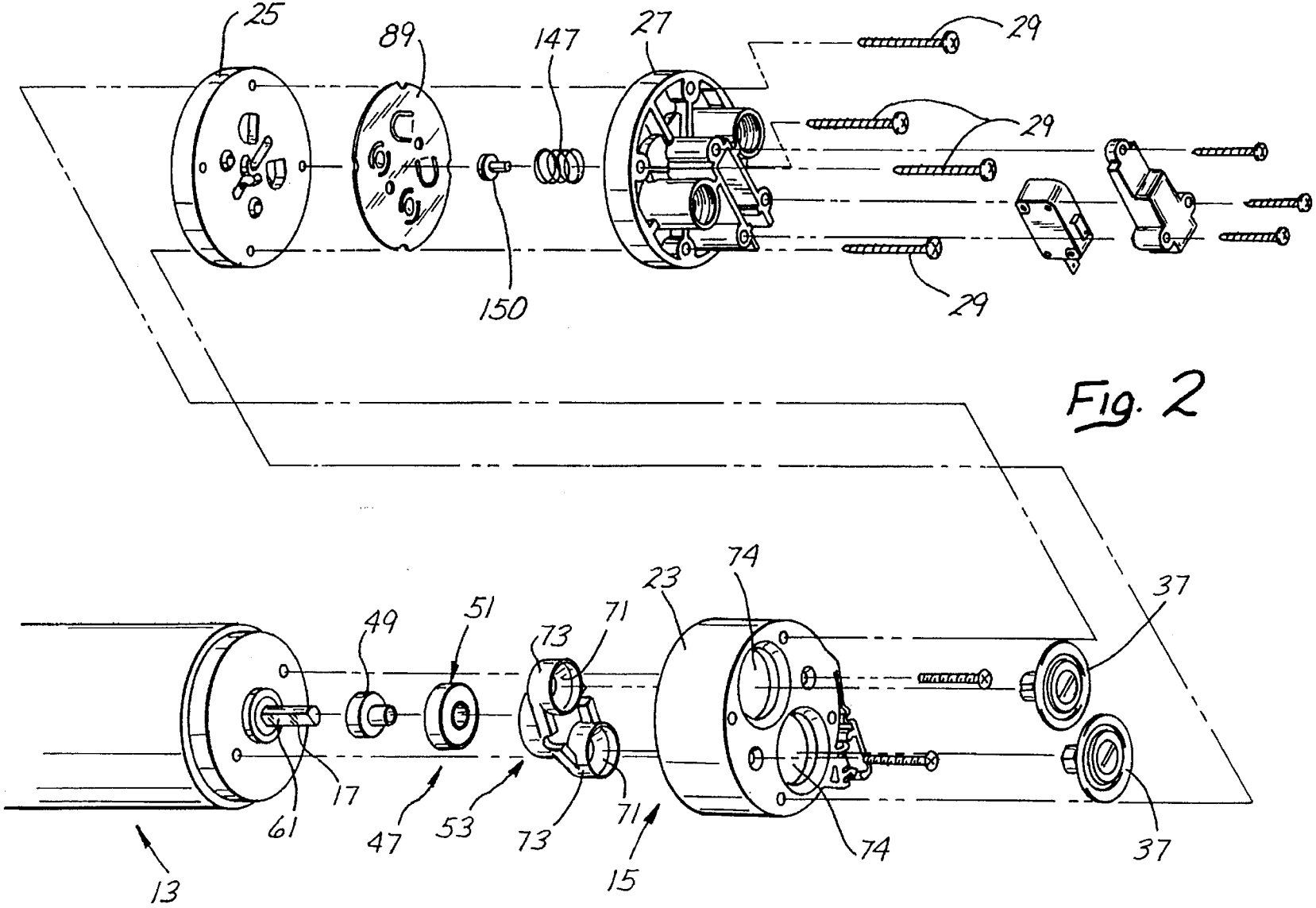
FIG. 2 is an exploded perspective view of the front portion of the pump shown in FIG. 1.

The pump 15 includes a housing 21 (FIG. 3) which includes an inner housing section 23, an intermediate housing section 25 and an outer housing section or cover 27 (FIGS. 2 and 3) which are held together and mounted on the motor 13 in any suitable manner such as by threaded fasteners 29 (FIG. 2). Each of the housing sections 23, 25 and 27 is preferably a one piece, molded member of a suitable polymeric material. As described more fully below, the pump 15, and in particular the intermediate housing section 25 has two identical pumping chambers 31 which are spaced apart, side-by-side, (FIG. 3) and these pumping chambers have identical pumping members 37, respectively, movable in the pumping chambers to pump a fluid or liquid such as water through the pump from an inlet 43 to an outlet 45 (FIGS. 4 and 4*a*) Although the pumping members 37 can be any kind of member that will pump a fluid, in this embodiment each of them is in the form of a separate and independent piston.

Figure 3:
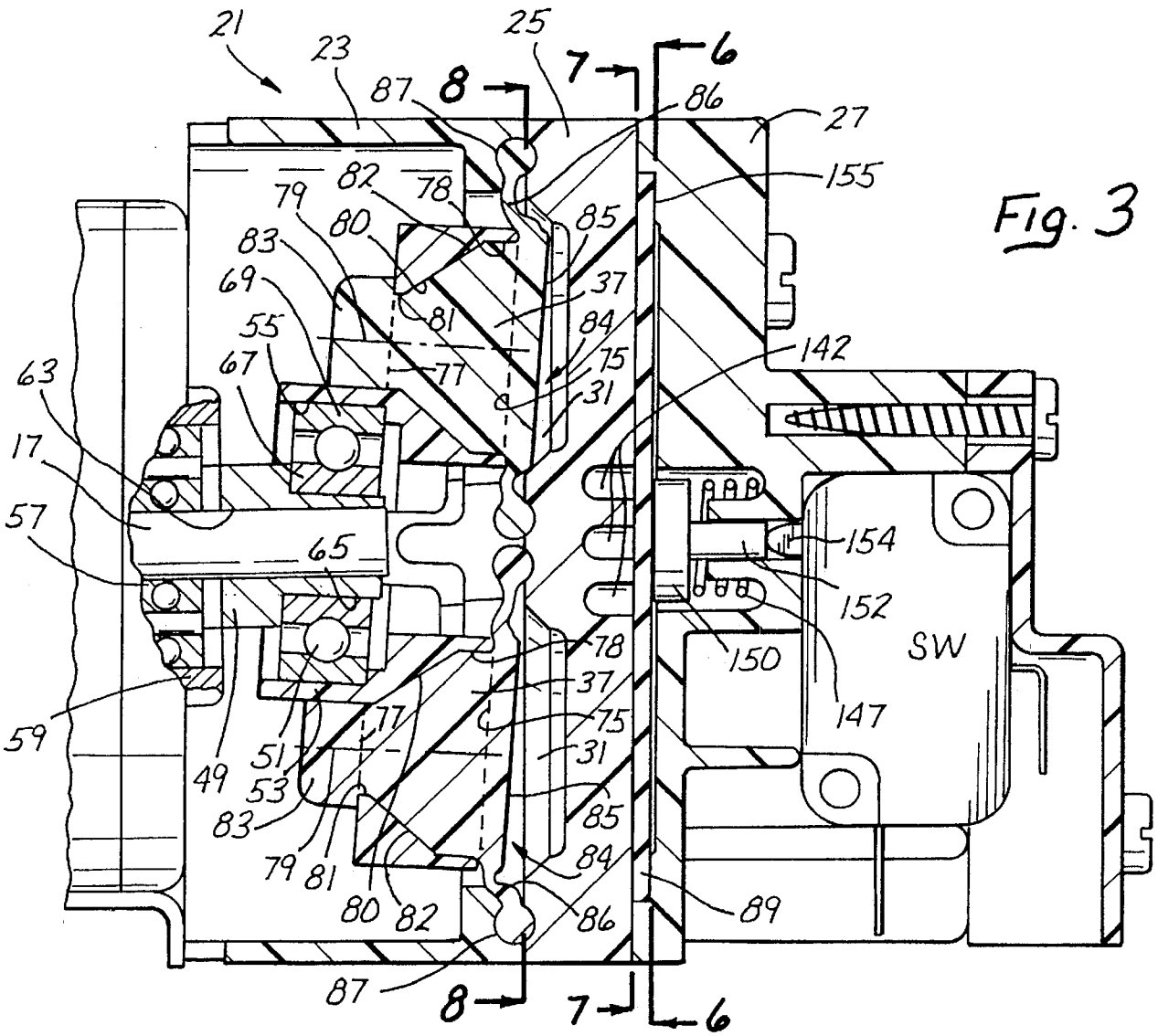
FIG. 3 is an enlarged fragmentary sectional view.

A drive 47 (FIG. 2) moves the pumping members 37 in the associated pumping chambers 31. Although the drive 47 may be any device which accomplishes this function, in this embodiment it includes a bushing 49 driven by the output shaft 17 of the motor 13, a ball bearing 51 which receives a portion of the bushing 49 as shown in FIG. 3 and a wobble plate 53 which has a pocket 55 in which the ball bearing 51 is received. The bushing 49 and the bearing 51 form a wobble mechanism for imparting wobbling motion to the wobble plate 53. As shown in FIG. 3, the output shaft 17 is rotatably supported by a bearing 57 supported by a motor housing 59 of the motor. Flats 61 on the output shaft 17 and on a bore 63 through the bushing 49 enables the output shaft to rotate the bushing. The bushing 49 has a cylindrical surface 65 with an axis which is skewed relative to the axis of the bore 63 and the ball bearing 51 has an inner race 67 which is suitably affixed to the cylindrical surface 65 and an outer race 69 which is suitably affixed to the wobble plate 53. Accordingly, rotation of the output shaft 17 causes the wobble plate 53 to undergo a wobbling or nutating motion which can sequentially drive the pumping members 37 on intake and discharge strokes. The drive 47 is not novel per se, and a similar wobble plate drive is shown in Hartley U.S. Pat. No. 4,396,357.

The wobble plate 53 is received within the inner housing section 23 and defines two open ended chambers 71. The two outer walls 73 of wobble plate 53 which surround the chambers 71 are (FIG. 2) received in two openings 74 of the inner housing section. Each of the open ended chambers 71 of wobble plate 53 includes a first end opening 75 and an opposing second end opening 77 (shown in shadow lines in FIG. 3). The inner walls of the wobble plate 53 between the openings 75 and 77 include a forward portion 78, which is parallel to the longitudinal axis 79 (FIG. 3) of the chambers 71, a relatively larger intermediate portion 80, which is disposed at an angle relative to the longitudinal axis, and a rearward portion 81, which is parallel to the longitudinal axis. The intermediate wall portion 80, which is a major portion, that is more than about 50%, of the total inner wall defining the chambers 71, forms a truncated cone with the larger part of the cone being forward, toward the pumping chamber 31.

The pumping members 37 are preferably made of a suitable flexible, resilient material, which may be a polymeric material or an elastomer with Santoprene sold by Monsanto being preferred. The pumping members 37 include an outer sidewall or surface 82 which corresponds or compliments the inner surface of the wobble plate defining the chambers 71. The pumping members 37 include an enlarged member 83 which has a larger cross-sectional area than second end opening 77. The pumping members 37 are received in the chambers 71 of the wobble plate 53 and are snap fitted or pushed, for example, using force from a mechanical press, so that the enlarged member 83 passes through and extends outwardly from second end opening 77 (as shown in FIG. 3).

The pumping members 37 include a head portion 84 which extends outwardly from the first end opening 75. Head portion 84 includes a central piston surface 85, an intermediate annular zone 86 which flexes as the pumping member moves between inlet and discharge strokes, and an outer annular portion 87. Outer portion 87 is sandwiched between the inner housing section 23 and the intermediate housing section 25, and forms a fluid tight annular seal so fluid cannot leak from pumping chambers 31 across the outer portion 87. No separate sealing diaphragm is needed in view of the configuration of the pumping member 37.

Figure 4:
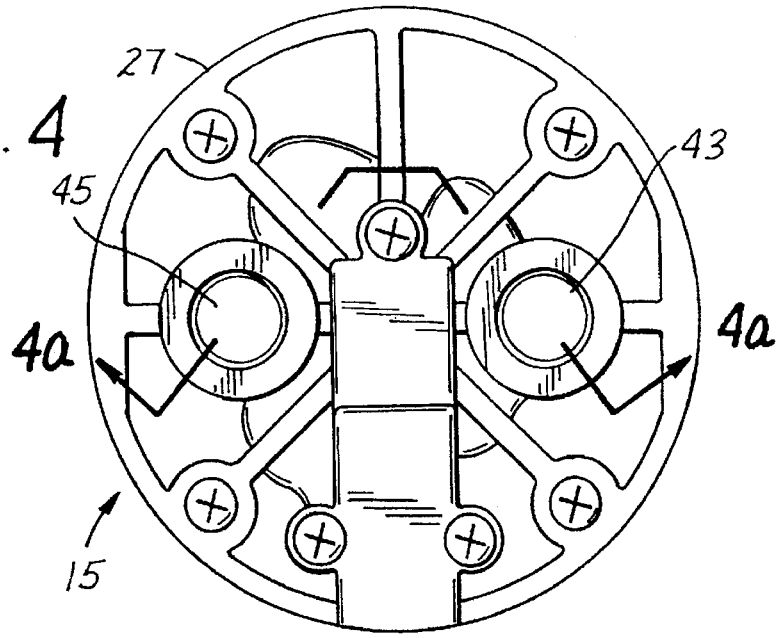
FIG. 4 is a front view of the cover of the pump shown in FIG. 1.

The intermediate housing section 25, the outer housing section 27 and a gasket or diaphragm 89 cooperate to define a flow path through the housing 21 from the inlet 43 to the outlet 45. As shown in FIGS. 3, 4 and the gasket 89 is sandwiched between the intermediate housing section 25 and the outer housing section 27. An inlet passage 91 leads from the inlet 43 to each of the pumping chambers 31. More specifically, the inlet passage 91 includes a bore 93 (FIG. 4*a*) in the outer housing section 27. Two identical inlet check valves 99 are provided, and the inlet passage 91 also includes two bores 101 in the outer housing section 27 leading to the inlet check valves to two inlet bores 102 to the two pumping chambers 31, respectively.

Each of the inlet check valves 99 includes a valve seat 113 (FIG. 4*a*) which is a surface of the outer housing section 27 and a movable valve element 115. The gasket 89 is integrally molded from a suitable resilient, flexible material such as a polymeric material or an elastomer with Santoprene being preferred, and as such forms a hinge joining each of the valve elements 115 to the remainder of the gasket 89 for pivotal movement between open and closed positions. In this embodiment, the gasket 89 has a generally U-shaped slot 117 (FIG. 5) partially around each of the valve elements 115 to separate the valve element from the surrounding regions of the gasket.

Figure 5:
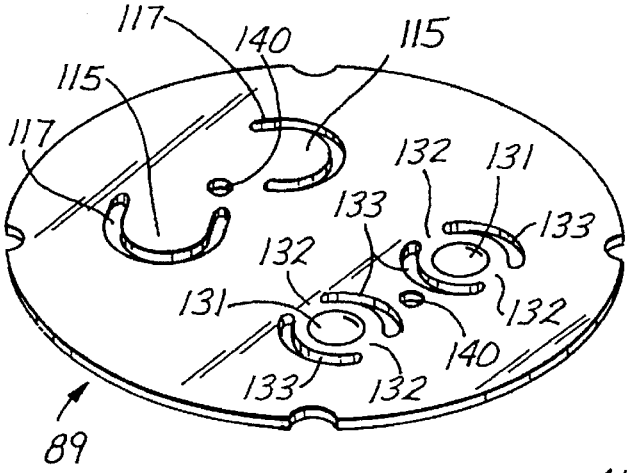
FIG. 5 is a top front view, in perspective, of the gasket.
Figure 4A:
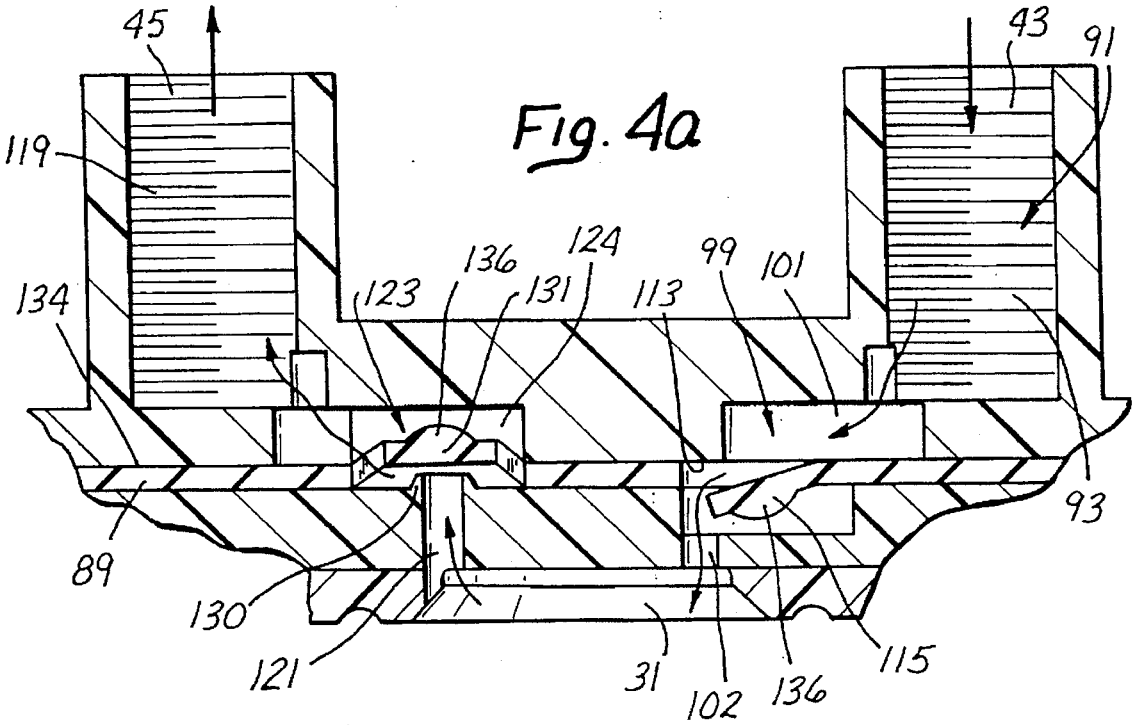
FIG. 4*a* is a fragmentary sectional view taken generally along line 4*a*–4*a* of FIG. 4. For illustrative purposes, both the inlet check valve and the outlet check valve are shown in the open position. During various stages of the operation of the pump, one of these valves is closed and the other is open.
Figure 4B:
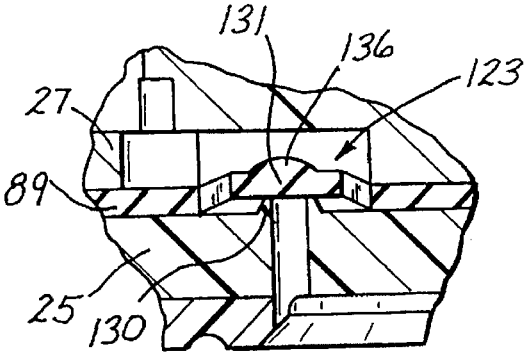
FIG. 4*b* is a fragmentary view showing outlet check valve in the closed position.
Figure 7:
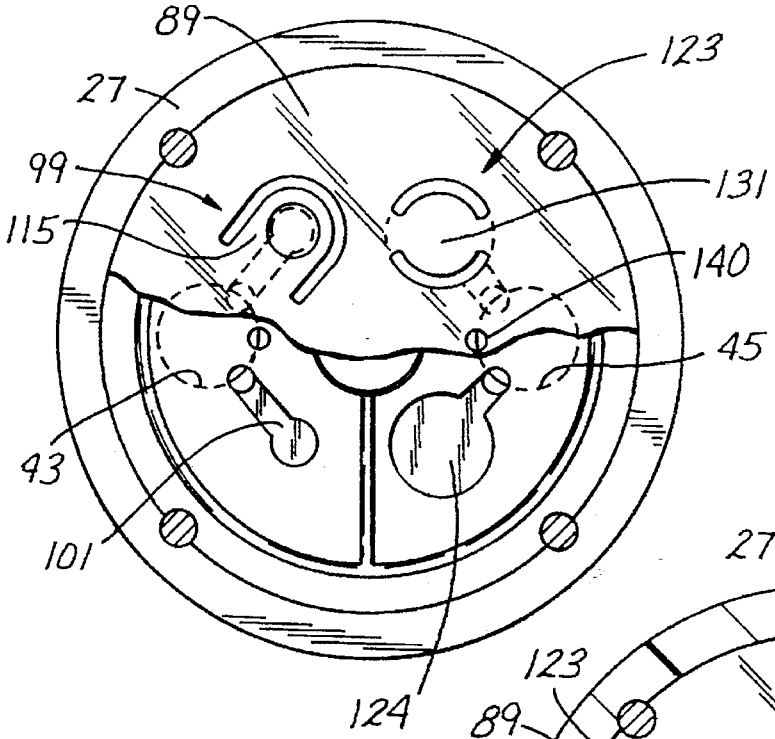
FIGS. 6 and 7 are fragmentary sectional views taken generally along lines 6—6 and 7—7 of FIG. 3 with a portion of the gasket broken away.

An outlet passage 119 leads from the pumping chambers 31 to the outlet 45. The outlet passage 119 includes two outlet bores 121 leading from the two pumping chambers 31, respectively, and two identical outlet check valves 123. Outer housing section 27 includes two exit bores 124 leading from the outlet check valves 123. Each of the outlet check valves 123 includes a valve seat 130, which is a raised surface of the intermediate housing section 25, and a valve element 131. As shown in FIG. 5, there are two of the valve elements 131, one for each of the pumping chambers 31. The valve elements 131 are formed integrally with the gasket 89 so that each of the valve elements are joined to the gasket at two diametrically opposed regions 132 and are partially circumscribed by two generally curved slots 133. Thus, the valve elements 131 can be moved (raised or lowered) between open and closed positions because of the flexing of the regions 132. The raised surface 130 in combination with the surface 134 of the outer housing section 27 places the valve element 131 under tension, or pre-loads the valve element, so that the valve 123 is biased toward the closed position, as shown in FIG. 4*b*. The amount of pre-loading can be varied, preferably controllably varied, depending, for example, on the material of construction of gasket 89 and the height of raised surface 130, among other factors. The normally closed outlet valves 123 are very effective in controlling the discharge of fluid from the pump 15. Such outlet valves 123 are particularly useful on anti-siphon valves. As best shown in FIG. 4*a*, each of the valve elements 115 and 131 has a central thickened region in the form of a dome 136 which strengthens the valve element.

Figure 6:
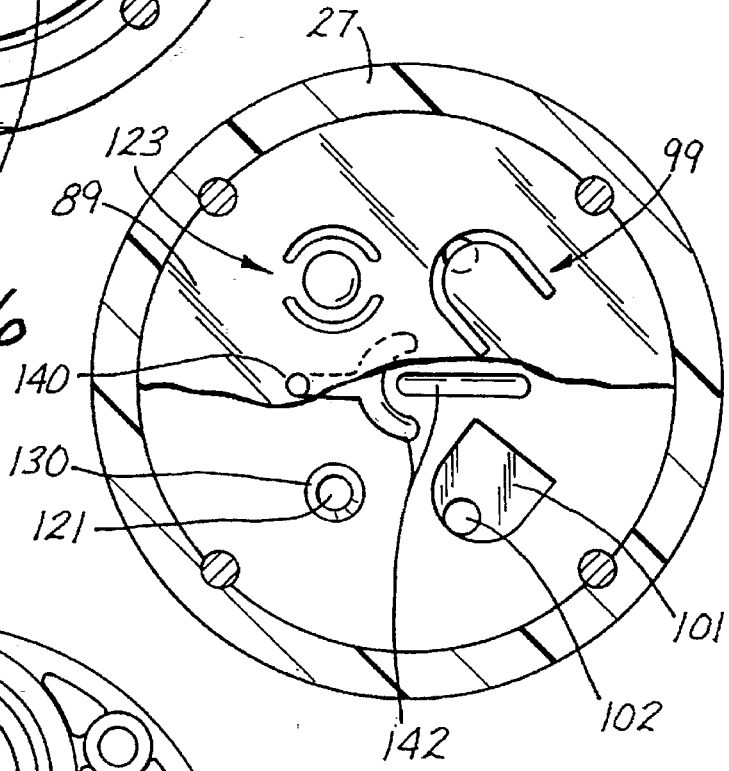
Figure 8:
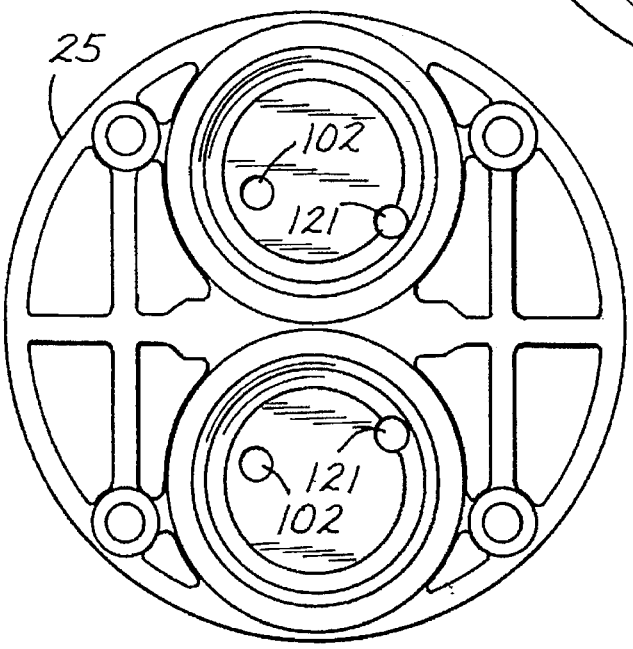
FIG. 8 is a fragmentary sectional view taken generally along line 8—8 of FIG. 3.

The pump 15 has a bypass passage 139 (FIG. 9) which leads from a location in the outlet passage 119 downstream of the outlet check valves 123, to a location in the inlet passage 91 upstream of the inlet check valves 99. The bypass passage 139 includes two bypass openings 140 in the gasket 89 (FIG. 6), and a bypass passage section or groove 142 in the intermediate housing section which is covered by the gasket. A bypass valve 141 (FIG. 9) includes a bypass valve seat 143, a region 145 of the gasket 89 and a biasing member in the form of a coil compression spring 147 which acts against such region of the gasket to bias such region against the valve seat 143. The spring 147 is received in a bore 149 of the outer housing section 27 and acts against a shoulder in that bore. The region 145 of the gasket 89 serves as a bypass valve element in that it cooperates with the valve seat 143 and the spring 147 to open and close the bypass valve 141. If the pressure in the outlet passage 119 is sufficient, it will force the region 145 of the gasket 89 upwardly as viewed in FIG. 9 off of the bypass valve seat 143 so that the fluid can be returned to the inlet passage 91.

Poppet 150, which is acted on by spring 147, includes a longitudinally extending element 152. With bypass valve 141 in the closed position, element 152 is spaced apart from pump switch member 154. However, with the bypass valve 141 in the fully open position, element 152 comes into contact with and depresses switch member 154. This, in turn, causes motor 13 to turn off. As the bypass valve 141 is closed, element 152 is moved out of contact with switch member 154. This causes the motor 13 to turn on. The relative positioning of element 152 and switch member 154 is such that a limited amount of fluid bypass occurs before the motor 13 is turned off. To illustrate, suppose the bypass valve 141 begins to open when the discharge pressure reaches 30 psi. The relative positioning of the element 152 and switch member 154 can be set so that the motor 13 is not turned off until the discharge pressure reaches 40 psi. This feature provides that the motor 13 is turned off only in situations where an actual need to shut the pump 15 down is present.

The gasket 89 cooperates with the outer housing section 27 to seal the bore 149, which contains the spring 147 against liquid entry.

As shown in FIG. 3, the gasket 89 is fitted into a cavity 155 in outer housing section 27.

It can be seen from the foregoing that the gasket 89 performs many valuable functions. First, the gasket seals between the housing sections 25 and 27 and also provides the valve elements 115 and 131 for the check valves 99 and 123, respectively. The gasket 89 also provides the region 145 which serves as the valve element for the bypass valve 141. The gasket 89 also provides various openings, such as the openings 140 (FIG. 5) which permit fluid flow through the pump 15 from the inlet 43 to the outlet 45. Consequently, a large number of functions are obtained from a one piece, unitary member, i.e. the gasket 89, and this gasket can be integrally molded from a suitable material.

In use of the pump 15, the motor 13 is energized to rotate the output shaft 17 (FIG. 2), the bushing 49 and the inner race 67. This causes the wobble plate 53 to wobble or nutate in a known manner to thereby drive the pumping members 37 on intake and discharge strokes which are out of phase with each other. On the intake stroke of a pumping member 37, the pumping member draws liquid from the inlet passage 91 (FIG. 4*a*) and in particular the inlet chamber 101 through the inlet check valve 99 and the bore 102 into the pumping chamber 31. The reduced pressure caused by movement of the pumping member 37 on the intake stroke causes the valve element 115 of the check valve 99 to pivot to the open position as shown in FIG. 4*a*. On the discharge stroke, the pumping member 37 forces fluid from the pumping chamber 31 through the outlet check valve 123 (FIG. 4*a*), the outlet chamber 124, and the outlet passage 119 to the outlet 45. During the discharge stroke, the higher pressure in the pumping chamber 31 forces the valve element 115 of the inlet check valve 99 against the valve seat 113 to a closed position. Conversely, during the intake stroke, the lower pressure within the pumping chamber 31 holds the valve element 131 of the outlet check valve 123 against its valve seat 130. This pumping action occurs in each of the pumping chambers 31, but in an out of phase relationship.

Figure 9:
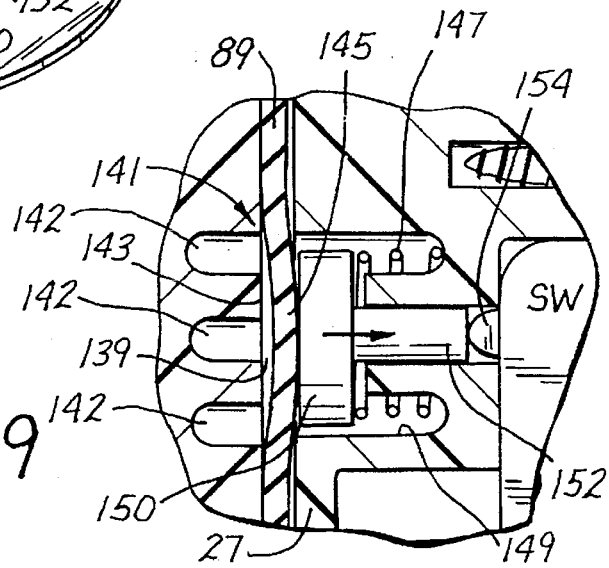
FIG. 9 is a fragmentary sectional view showing the bypass valve in the open position.

Fluid in the outlet chamber 125 also enters the bypass passage 139 to act on the region 145 of the gasket 89 as shown in FIG. 9. Under ordinary operating conditions, the force of the spring 147 is sufficient to hold the region 145 against the valve seat 143 thereby maintaining the bypass valve 141 closed. However, if the pump 15 continues operation and pressure in the outlet chamber 125 increases as a result of a restriction downstream of the outlet 45, the pressure in the bypass passage 139 acting against the region 145 of the gasket 89 and the spring 147 increases sufficiently to lift the region 145 off of the valve seat 143 thereby opening the bypass valve 141 and allowing flow through the bypass passage 139 back to the inlet passage 91.

Although an exemplary embodiment of the invention has been shown and described, many changes, modifications and substitutions may be made by one having ordinary skill in the art without necessarily departing from the spirit and scope of this invention.

What is claimed is:

1. A pump comprising:

a housing including first and second housing sections;

a gasket between the first and second housing sections and including a section of flexible material;

at least one fastener for holding the first and second housing sections together;

said housing having at least a first pumping chamber, an inlet opening, an inlet passage in the housing leading from the inlet opening to the pumping chamber, an outlet opening and an outlet passage in the housing leading from the pumping chamber to the outlet opening;

a first pumping member movable in the first pumping chamber on an intake stroke whereby a fluid from the inlet passage is drawn into the first pumping chamber and a discharge stroke whereby fluid in the first pumping chamber is discharged into the outlet passage;

a drive for moving the pumping member on the intake and discharge strokes;

an inlet check valve in the inlet passage including an inlet valve seat and a movable inlet valve element which is integrally joined to the section of flexible material about a hinge whereby the movable inlet valve element is pivotable between open and closed positions; and an outlet check valve in the outlet passage including an outlet valve seat and a movable outlet valve element secured to the gasket at at least two spaced apart regions.

2. The pump as defined in claim 1 wherein the movable outlet valve element is secured to the gasket at two substantially opposing regions.

3. The pump as defined in claim 1 wherein the movable outlet valve element is under tension to bias the outlet check valve toward the closed position.

4. The pump as defined in claim 1 wherein said gasket includes flexible material and the movable outlet valve element is integrally joined to the flexible material of the gasket whereby the movable outlet check valve element is movable between open and closed positions.

5. The pump as defined in claim 1 wherein the gasket is integrally formed as a unitary one piece member.

6. The pump as defined in claim 1 wherein the gasket includes the valve elements of both of the check valves.

7. The pump as defined in claim 1 wherein the pump includes a second pumping chamber, an inlet check valve for the second pumping chamber in the inlet passage, an outlet check valve for the second pumping chamber in the outlet passage, and the gasket includes at least one of the valve elements for the second pumping chamber.

8. The pump as defined in claim 7 wherein the gasket includes both of the valve elements for the second pumping chamber and the outlet check valves are spaced apart and are structured substantially identically.

9. The pump as defined in claim 1 including a bypass passage in said housing leading from a location in the outlet passage downstream of the outlet check valve to a location in the inlet passage upstream of the inlet check valve, a bypass valve including a bypass valve seat in the bypass passage, a region of said gasket and a biasing member for biasing said region of the gasket against the bypass valve seat to close the bypass passage, said region of the gasket being responsive to fluid under pressure from the outlet passage exceeding a magnitude for moving off of the bypass valve seat to open the bypass passage.

10. The pump as defined in claim 1 wherein said drive includes a wobble plate for driving the pumping member and a wobble mechanism mounted in said housing for imparting wobbling motion to the wobble plate.

11. The pump as defined in claim 10 wherein the wobble plate defines a first open ended chamber having two opposing open ends and the first pumping member is removably secured to the wobble plate, is partially located within the first open ended chamber and extends outwardly from both of the opposing open ends.

12. The pump as defined in claim 11 wherein the first open ended chamber has a longitudinal axis and is at least partially defined by an interior surface angled relative to the longitudinal axis, and the first pumping member includes a correspondingly angled surface in close proximity to the angled interior surface.

13. A pump comprising:

a housing;

a wobble plate in the housing, said wobble plate defining a chamber having a longitudinal axis and is at least partially defined by an interior surface angled relative to the longitudinal axis and extending over at least a major portion of the length of the chamber;

a wobble mechanism mounted in said housing for imparting wobbling motion to the wobble plate;

said housing having at least a first pumping chamber, an inlet opening, an inlet passage in the housing leading from the inlet opening to the pumping chamber, an outlet opening and an outlet passage in the housing leading from the pumping chamber to the outlet opening;

a pumping member partially located in the chamber defined by the wobble plate, removably secured to the wobble plate and driven by the wobble plate, the pumping member being movable in the pumping chamber on an intake stroke whereby a fluid from the inlet passage is drawn into the pumping chamber and a discharge stroke whereby fluid in the pumping chamber is discharged into the outlet passage; and said pumping member including a correspondingly angled surface in close proximity to the interior surface of the chamber.

14. The pump as defined in claim 13 wherein the interior surface of the chamber has a truncated conical configuration.

15. The pump as defined in claim 13 wherein the chamber defined by the wobble plate has opposing first and second open ends, and the pumping member extends outwardly from both the opposing first and second open ends, and includes an element located outwardly from the opposing open end of the chamber away from the pumping chamber, said element having a larger cross-sectional area than the opening of the opposing open end of the chamber away from the pumping chamber.

16. The pump as defined in claim 13 wherein the housing has a second pumping chamber, the wobble plate defines a second chamber having a longitudinal axis and is partially defined by a second interior surface angled relative to the longitudinal axis and extending over at least a major portion of the length of the second chamber, the pump including a second pumping member partially located in the second chamber defined by the wobble plate, removably secured to the wobble plate and driven by the wobble plate, the second pumping member being movable in the second pumping chamber on an intake stroke whereby a fluid from the inlet passage is drawn into the second pumping chamber and a discharge stroke whereby fluid in the second pumping chamber is discharged into the outlet passage, the second pumping member including a correspondingly angled surface in close proximity to the second interior surface of the chamber.

17. A pump comprising:

a housing having a first pumping chamber, a second pumping chamber, an inlet opening, an inlet passage in the housing leading from the inlet opening to the pumping chambers, an outlet opening and an outlet passage in the housing leading from the pumping chambers to the outlet passage;

a wobble plate in the housing, the wobble plate defining first and second open ended chambers each of which having a first open end positioned generally toward the pumping chamber and an opposing second open end positioned generally away from the pumping chamber with the first open end being larger than the second open end;

a wobble mechanism mounted in the housing for imparting wobbling motion to the wobble plate;

a first pumping member driven by the wobble plate, removably secured to the wobble plate and partially located within the first open ended chamber and extending outwardly from both of the opposing open ends, the first pumping member being movable in the first pumping chamber on an intake stroke whereby a fluid from the inlet passage is drawn into the first pumping chamber and a discharge stroke whereby fluid in the first pumping chamber is discharged into the outlet passage;

a second pumping member driven by the wobble plate, removably secured to the wobble plate and partially located within the second open ended chamber and extending outwardly from both of the opposing ends, the second pumping member being movable in the second pumping chamber on an intake stroke whereby a fluid from the inlet passage is drawn into the second pumping chamber and a discharge stroke whereby fluid in the second pumping chamber is discharged into the outlet passage; and the first and second pumping members are separate from and independent of each other.

18. The pump as defined in claim 17 wherein each of the first and second pumping members includes an element located outwardly from the opposing open end of the open ended chamber away from the pumping chamber, said element having a larger cross-sectional area then the opening of the opposing open end of the open ended chamber away from the pumping chamber.

19. The pump as defined in claim 17 wherein each of said first and second pumping members include a face portion located outwardly from the opposing open end of the open ended chamber in proximity to the pumping chamber, a flexible region circumscribing the face portion and a seal portion circumscribing the flexible region, secured to the housing and providing a fluid tight seal so that fluid in the pumping chamber is prevented from leaking across the seal portion.

* * * * *